United States Patent [19]

Brunner

[11] Patent Number: 4,658,984

[45] Date of Patent: Apr. 21, 1987

[54] SHIPPING AND DISPENSING CONTAINER FOR DRINKING STRAWS

[75] Inventor: Donald W. Brunner, Glendale, Calif.

[73] Assignee: Diamond Straw Incorporated, Los Angeles, Calif.

[21] Appl. No.: 629,053

[22] Filed: Jul. 9, 1984

[51] Int. Cl.[4] ..... B65D 5/72; B65D 83/02; A47F 1/12

[52] U.S. Cl. ..... 221/64; 206/443; 221/305; 221/306; 229/17 B

[58] Field of Search ..... 221/64, 307, 309, 303, 221/243, 193, 312 C, 311, 305, 306, 178, 204, 205, 191, 260, 289, 299, 200–203, 254–257, 294–297, 312 R, 268, 272, 274, 276, 290, 301, 179, 180, 182–184, 161, 167, 168, 267, 269, 171, 193, 156, 157, 163, 175, 177, 188; 206/44.12, 443; 229/17 B, 17 M, 7 R, 7 S

[56] References Cited

U.S. PATENT DOCUMENTS

| | | | |
|---|---|---|---|
| 651,324 | 6/1900 | Doremus | 221/306 X |
| 918,085 | 4/1909 | Parker | 221/202 |
| 1,000,624 | 8/1911 | Pexton | 229/17 B |
| 1,087,148 | 2/1914 | Shonk | 221/269 |
| 1,985,585 | 12/1934 | Stone | 221/289 X |
| 2,145,181 | 1/1939 | Kennedy | 221/305 |
| 2,770,408 | 11/1956 | Lindeberg | 229/17 B |
| 3,944,128 | 3/1976 | Hogan | 221/305 X |

FOREIGN PATENT DOCUMENTS

| | | | |
|---|---|---|---|
| 221961 | 6/1959 | Australia | 221/191 |

*Primary Examiner*—Joseph J. Rolla
*Assistant Examiner*—Kevin P. Shaver
*Attorney, Agent, or Firm*—Freilich, Hornbaker, Rosen & Fernandez

[57] ABSTRACT

A thin cardboard container is provided for holding drinking straws during both shipping of the straws and dispensing of the straws in a restaurant or the like. The container includes a straw-supporting inclined wall (34) which extends at a downward incline from the top-rear of the container to the bottom-front, to urge the straws to move out of a gap (16) at the bottom of the front wall of the container. When the bottom of the front wall is deflected inwardly, it passes over a single straw to enable grasping and removal of the single straw. A closing wall (14) which extends up from the bottom wall, can be pivoted from a closed position wherein it extends vertically to close the gap at the bottom of the front wall, to an open position wherein it permits access to a straw lying forward of the bottom wall. The closing wall includes a pair of tabs (40,42) at either side for retaining it in both its closed and open positions.

5 Claims, 3 Drawing Figures

SHIPPING AND DISPENSING CONTAINER FOR DRINKING STRAWS

BACKGROUND OF THE INVENTION

Drinking straws are typically shipped to a restaurant in boxes formed of thin cardboard that each contain perhaps 100 to 200 straws each. At the restaurant, a clerk removes the straws from the box and places the straws in a dispensing machine which dispenses one straw at a time. If the shipping container could also be used as the dispensing machine, without substantial additional cost for the cardboard shipping container, clerks could save time which is otherwise used in transferring straws to the dispensing container and keeping the dispensing container clean.

SUMMARY OF THE INVENTION

In accordance with one embodiment of the present invention, an apparatus of modest cost is provided which can be used both for storing drinking straws and for dispensing them one-at-a-time. The apparatus includes a container having a substantially vertical flexible front wall whose bottom lies a small distance above the bottom wall which is about equal to the diameter of a drinking straw. An inclined wall extends at a downward-forward incline towards the opening, to support a large number of straws and urge them to pass out through the opening or gap which lies under the front wall. When the bottom of the front wall is pushed back, a single straw can pass under the front wall and the straw can be easily removed.

A short closing wall extends upwardly from the front of the bottom wall. The closing wall can pivot between a closed position wherein it lies closely in front of the front wall to close the gap through which straws are dispensed, and an open position wherein it is angled from the vertical to permit access to a straw which has passed under the front wall. The closing wall has tabs on either side which extend through slots at opposite sides of the front wall. The tabs permit the closing wall to slide from a closed position to an open position, but prevent the closing wall from pivoting beyond about a 50 degree angle from the vertical.

The novel features of the invention are set forth with particularity in the appended claims. The invention will be best understood from the following description when read in conjunction with the accompanying drawings.

DESCRIPTION OF A PREFERRED EMBODIMENT

Figure 1:
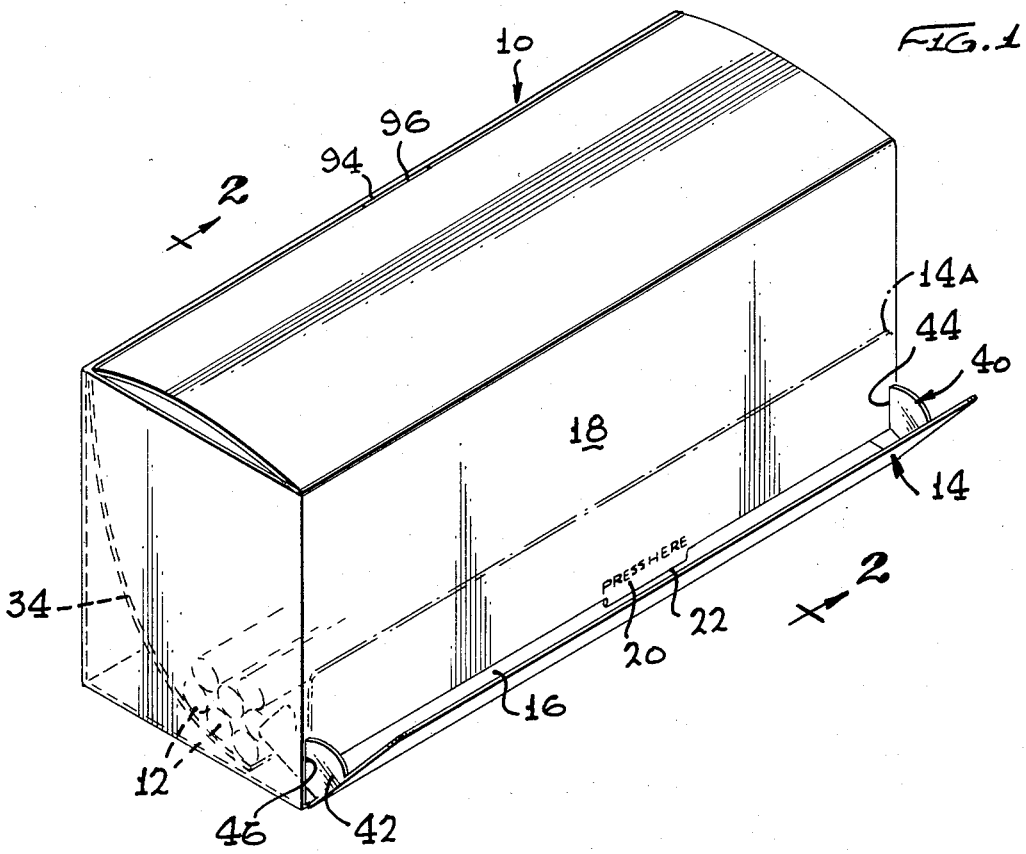
FIG. 1 is a front perspective view of a container constructed in accordance with the present invention, shown with the closing wall in an open position.
Figure 2:
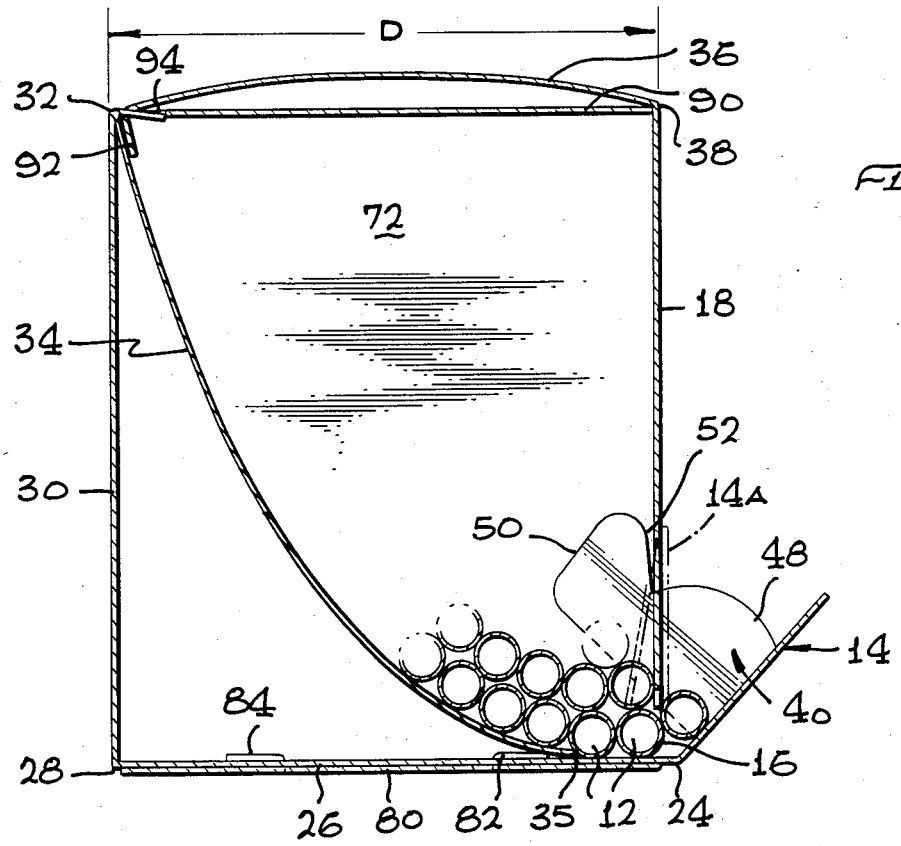
FIG. 2 is a view taken on the line 2—2 of FIG. 1.

FIGS. 1 and 2 illustrate a container 10 for holding drinking straws 12, wherein the container can be used for storing and shipping the straws when the container must be kept relatively well sealed, and for dispensing the straws in a restaurant or the like when access to a single straw at a time is required. In the dispensing configuration shown in FIGS. 1 and 2, a closing wall 14 of the container lies in an open position, to reveal an open area or gap 16 which lies under a front wall 18 of the container. When a person presses rearwardly on the bottom of the front wall at 20, a single straw passes under the bottom 22 of the front wall, and the person can pick up that straw for use. For shipment of the container with the straws therein, the closing wall 14 is retained in a closed position shown at 14A, wherein it closes the gap 16 that lies under the front wall. The closing wall extends upwardly by less than half the height of the front wall, so the closing wall does not significantly interfere with access to a straw in the open position, and so it remains firmly in the closed position even though it is held by tabs at its bottom.

The container is constructed of a cut and pasted sheet of cardboard, with various crease or fold lines formed therein. The bottom of the closing wall 14 is pivotally connected at a fold line 24 (FIG. 2) to a bottom wall 26, and the rear of the bottom wall 26 is pivotally connected at a fold line 28 to a rear wall 30. The top of the rear wall is connected at a fold line 32 to an incline wall 34 which extends at a generally downward-forward incline towards the forward portion of the bottom wall 26. A person at the straw-manufacturing factory can load the straws into the container when the top wall 36 has been pivoted open at a pivot line 38. The straws rest on the inclined wall 34 and deform it to the position shown in FIG. 2 wherein its lower end 35 is spaced behind the front wall. The inclined wall urges the straws to move forwardly as well as downwardly, so that they are urged to pass through the gap 16. The fact that the inclined wall 34 can sag, results in the container being able to hold about 80% of the straws which could be held in the absence of the inclined wall.

The gap 16 (FIG. 1) is wide enough to pass a straw, except that there is little if any clearance at the region under the pressing area 20. When a person presses rearwardly on the area 20, the bottom 22 passes over a single straw which can then be grasped and removed. The single straw usually does not move backward because there is forward pressure on it from the straws on the inclined wall. If, for any reason, a straw cannot pass under the area 20, a person can still see an end of the straw outside the area 20, and grasp the straw there. The closing wall 14 which extends at an upward-forward incline of about 40° from the horizontal, permits easy access to a straw, while serving as a barrier that prevents multiple straws from rolling out of the gap 16.

The closing wall 14 is maintained in either its open or closed positions by a pair of tabs 40, 42 which extend rearwardly from opposite sides of the closing wall and through tab-guiding slots 44,46 formed on opposite sides of the front wall 18. Each tab includes a forward portion 48 (FIG. 2) which can freely slide along the slot in moving the closing wall between open and closed positions, and a rearward portion 50 which stops the closing wall from pivoting forward by more than about 50° from the vertical. The rearward portion has a stop surface 52 which extends largely vertically and which abuts the area of the front wall lying immediately above the slot such as 44 when the closing wall is in its open position, to limit pivoting of the closing wall.

Figure 3:
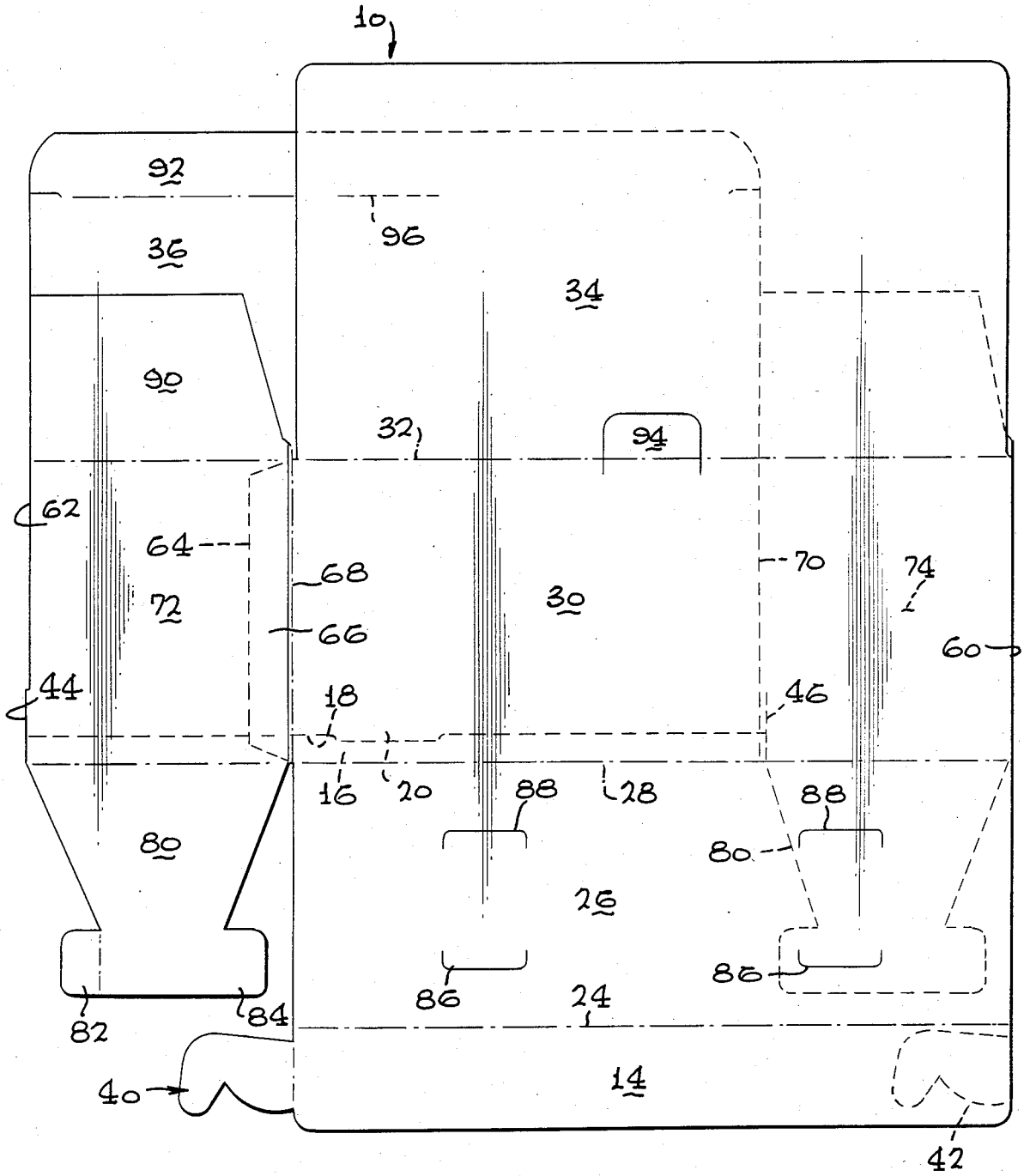
FIG. 3 is a plan view of the container of FIG. 1, shown in an undeployed position wherein it includes a pair of sheets that are joined together but which lay facewise against one another.

FIG. 3 shows the container 10 in a flat configuration, ready to be deployed to a box shape. The container includes a single sheet of cardboard which has been folded along the lines 60, 62, and with one end 64 of the sheet glued to the opposite end 66. The flattened container can be moved to the deployed position of FIGS. 1 and 2, by first pivoting it about fold lines 60, 62, 68, 70, so that the front and back walls 18, 30 and opposite sides 72, 74 are spaced apart to form the sides of a rectangle.

The bottom wall 26 is then folded at 90° to the rear wall 30, and the closing wall 14 is folded up from the bottom wall around fold line 24. The tabs 40, 42 are folded to extend perpendicular to the closing wall, and the tabs are inserted through the slots 44, 46. The inclined wall 34 is bent so that it extends at a downward-forward incline within the container. Bottom flaps 80 are folded under the bottom wall, and their bottom retainers 82, 84 are inserted through holes 86, 88 formed by slits in the bottom wall. Flaps 90 at the top of the side walls are folded over the inside of the container.

A top wall 36 is folded down over the flaps, with a top wall flap 92 inserted immediately in front of the top of the inclined wall, and a rear wall retainer 94 inserted through a slit 96 at the top of the top wall flap. Prior to closing the top wall 36, a group of straws 12, is loaded into the container to rest on the inclined wall 34. The completed container with straws therein, and with the closing wall 14 in its closing position, can be shipped to a restaurant and stored there until needed. Then, the container can be placed at a location where individual straws are needed, and the closing wall 14 opened to the position shown in FIGS. 1 and 2.

In containers that have been manufactured as shown in the drawings, the container as shown in FIG. 2 had a horizontal depth D of 10 cm and a height of 11.7 cm. The container had a width of 28 cm and was loaded with 150 drinking straws, each having an outside diameter of about 8 mm and a length of 26.7 cm. The dimensions of different portions of the box are accurately shown in FIG. 3.

Thus, the invention provides a container of only moderate cost, which can be used for both storing and dispensing of drinking straws. Dispensing of individual straws is achieved by the use of an incline wall which urges the straws to be dispensed through a gap lying under the bottom of a front wall. The front wall can be flexed forward to ride over a single straw, to dispense a single straw at a time. A closing wall can close the gap for shipment and storage of the container, and the closing wall can be pivoted to an open position at which it permits access to the gap for the dispensing of straws, and also prevents rolling away of straws out of the gap.

Although particular embodiments of the invention have been described and illustrated herein, it is recognized that modifications and variation may readily occur to those skilled in the art and consequently, it is intended that the claims be interpreted to cover such modifications and equivalents.

What is claimed is:

1. Apparatus for storing and dispensing drinking straws comprising:

a container formed of a single sheet of cardboard which includes a substantially vertical flexible front wall, a rear wall, a bottom wall, a top wall, and a straw-supporting inclined wall which extends from the top of the rear wall in a downward-forward incline to the forward portion of the bottom wall, and forming a substantially horizontal surface at the front of the bottom wall; and a group of drinking straws resting on said inclined wall;

the bottom of the front wall lying above the bottom wall by a distance about equal to the diameter of one of said drinking straws, so when the bottom of the front wall is bent rearwardly it can pass over a single straw to enable grasping of the single straw.

2. The apparatus described in claim 1 wherein:

said flexible front wall has opposite sides and an upper portion joined at either side to said side walls and integral with at least part of said side walls, and said flexible front wall has a lower portion separated by slots from said side wall, to permit the lower portion of the flexible front wall to bend so its lower edge moves rearwardly and upwardly.

3. The apparatus described in claim 1 wherein:

said container can lie in an undeployed configuration wherein it can lie with two layers of cardboard one on the other;

said container having opposite side walls and in said undeployed configuration each side wall joins said front and rear walls, said bottom wall extends from the bottom of said rear wall, and said top wall extends from the top of said front wall.

4. The apparatus described in claim 1 wherein:

said inclined wall is flexible, and has a lower end that rests substantially facewise on said bottom wall with the bottom edge of the inclined wall behind the forward edge of the bottom wall, so straws roll onto the bottom wall before passing under the front wall.

5. Apparatus for storing and dispensing drinking straws, including a single sheet of cardboard comprising:

a pair of opposite side walls, a front wall with opposite sides and a top and a bottom, and a rear wall with opposite sides and a top and a bottom, each side wall foldably joining at least a portion of one side of said wall front wall to one side of said rear wall, the walls being unfoldable to form a rectangular shape as seen in cross-section;

a bottom wall foldably joined to the bottom of the rear wall, and which can lie under said rectangular shape formed by said walls;

a flexible inclined wall which is integral with at least a portion of the rear wall and which can extend from the top of said rear wall and at a downward incline to the bottom wall at a location near the bottom of the front wall;

a top wall which can extend across the top of said rectangular shape formed by said walls;

a pair of bottom flaps extending from the bottom of each side wall and holding the bottom wall;

the bottom of said front wall lying a distance above the bottom wall about equal to the diameter of said straws, a bottom portion of said front wall being unjoined to said side walls and being bendable, whereby to permit rearward deflection of the bottom of the front wall to dispense a straw.

* * * * *